US005412810A

United States Patent [19]

Taniuchi

[11] Patent Number: 5,412,810

[45] Date of Patent: May 9, 1995

[54] HELMET FOR RIDING VEHICLE

[75] Inventor: Fujio Taniuchi, Tokyo, Japan

[73] Assignee: Shoei Kako Kabushiki Kaisha, Tokyo, Japan

[21] Appl. No.: 177,936

[22] Filed: Jan. 6, 1994

[30] Foreign Application Priority Data

Jul. 28, 1993 [JP] Japan ..... 5-041021 U

[51] Int. Cl.[6] ..... A42B 1/08

[52] U.S. Cl. ..... 2/424; 2/410; 2/422

[58] Field of Search ..... 2/410, 411, 421, 422, 2/424, 425, 414, 415, 916, 909

[56] References Cited

U.S. PATENT DOCUMENTS

| | | | |
|---|---|---|---|
| 3,825,952 | 7/1974 | Pershing et al. | 2/422 |
| 4,538,303 | 9/1985 | Schnitzler | 2/424 |
| 4,697,289 | 10/1987 | Luigi | 2/422 |
| 4,769,857 | 9/1988 | Cianfanelli et al. | 2/424 |
| 4,794,652 | 1/1989 | Piechvon Planta et al. | 2/424 |
| 5,084,918 | 2/1992 | Breining et al. | 2/424 |
| 5,095,550 | 3/1992 | Perlinger | 2/422 |
| 5,161,261 | 11/1992 | Kamata | 2/424 |

FOREIGN PATENT DOCUMENTS

| | | | |
|---|---|---|---|
| 1526574 | 9/1978 | United Kingdom . | |
| 1576647 | 10/1980 | United Kingdom | 2/424 |

*Primary Examiner*—Clifford D. Crowder
*Assistant Examiner*—Michael A. Neas
*Attorney, Agent, or Firm*—Armstrong, Westerman, Hattori, McLeland & Naughton

[57] ABSTRACT

In a helmet for riding a vehicle, a chin cover is expandably and contractibly upholstered at a lower edge of a chin covering portion for covering the user's chin. At least a portion of the chin cover is formed of a mesh material, so that the flowing-out of a user's exhalation through the mesh material is promoted by wind flowing along a lower surface of the chin cover. Thus, it is possible to prevent a wind-cutting sound due to an inclusion of the wind into the chin covering portion of the cap body and to eliminate the stay of the user's exhalation in the chin covering portion.

4 Claims, 5 Drawing Sheets

HELMET FOR RIDING VEHICLE

BACKGROUND OF THE INVENTION

2. Field of the Invention

The field of the present invention is helmets for use by an occupant of a vehicle such as a motorcycle or a racing car, and particularly, improvements in helmets of a type having a chin covering portion provided in a cap body for covering a user's chin, and a chin cover expandably and contractibly upholstered at a lower edge of the chin covering portion for covering the user's chin.

2. Description of the Prior Art

If an occupant, for example, on a motorcycle uses a helmet of the above-described structure, it is possible to prevent the entry of running wind between the chin covering portion and the user's chin by the chin cover, even during traveling at a high speed, thereby inhibiting the generation of a wind-cutting sound.

The chin cover of the prior art helmet is made of a soft foam of synthetic resin material and has no air-permeability, as disclosed in, for example, Japanese Utility Model Publication No.16180/93.

In the prior art helmet, a user's exhalation may stay in the chin covering portion to cloud an inner surface of a shield plate, because the chin cover is non-breathable as described above.

SUMMARY OF THE INVENTION

Accordingly, it is an object of the present invention to provide a helmet for riding a vehicle of the type described above, in which the problem of the reside breath exhalation in the chin covering portion can be overcome.

To achieve the above object, according to the present invention, there is provided a helmet for riding a vehicle in which at least a portion of the chin cover is formed of a mesh material.

With the above construction, it is possible to inhibit the entry of wind into the chin covering portion of a cap body by the chin cover during movement of a vehicle at a high speed and to promote flowing-out of the user's exhalation through the mesh material by wind flowing along a lower surface of the chin cover. Thus, it is possible to prevent the generation of a wind-cutting sound and to prevent the clouding of an inner surface of a shield plate due to the residue breath exhalation.

In addition to the above feature, the cap body may be comprised of a main cap body having a large window opened at its lower end in a front surface, an auxiliary cap body having a chin covering portion and pivotally carried on left and right opposite sidewalls of the main cap body for turning movement between a lowered position in which a lower half of the large window is covered by the chin covering portion for making an upper half of the large window into a small window, and a lifted position in which the entire large window is opened. With such a construction, when the cap body is attached or detached, the attaching and detaching of the main cap body can be performed without any obstruction by the auxiliary cap body and the chin cover, by previously turning the auxiliary cap body to the lifted position. Therefore, a user's hair cannot be disheveled by the auxiliary cap body and the chin cover.

The above and other objects, features and advantages of the invention will become apparent from the following description of a preferred embodiment taken in conjunction with the accompanying drawings.

DESCRIPTION OF THE PREFERRED EMBODIMENT

The present invention will now be described by way of a preferred embodiment in connection with the accompanying drawings.

Figure 1:
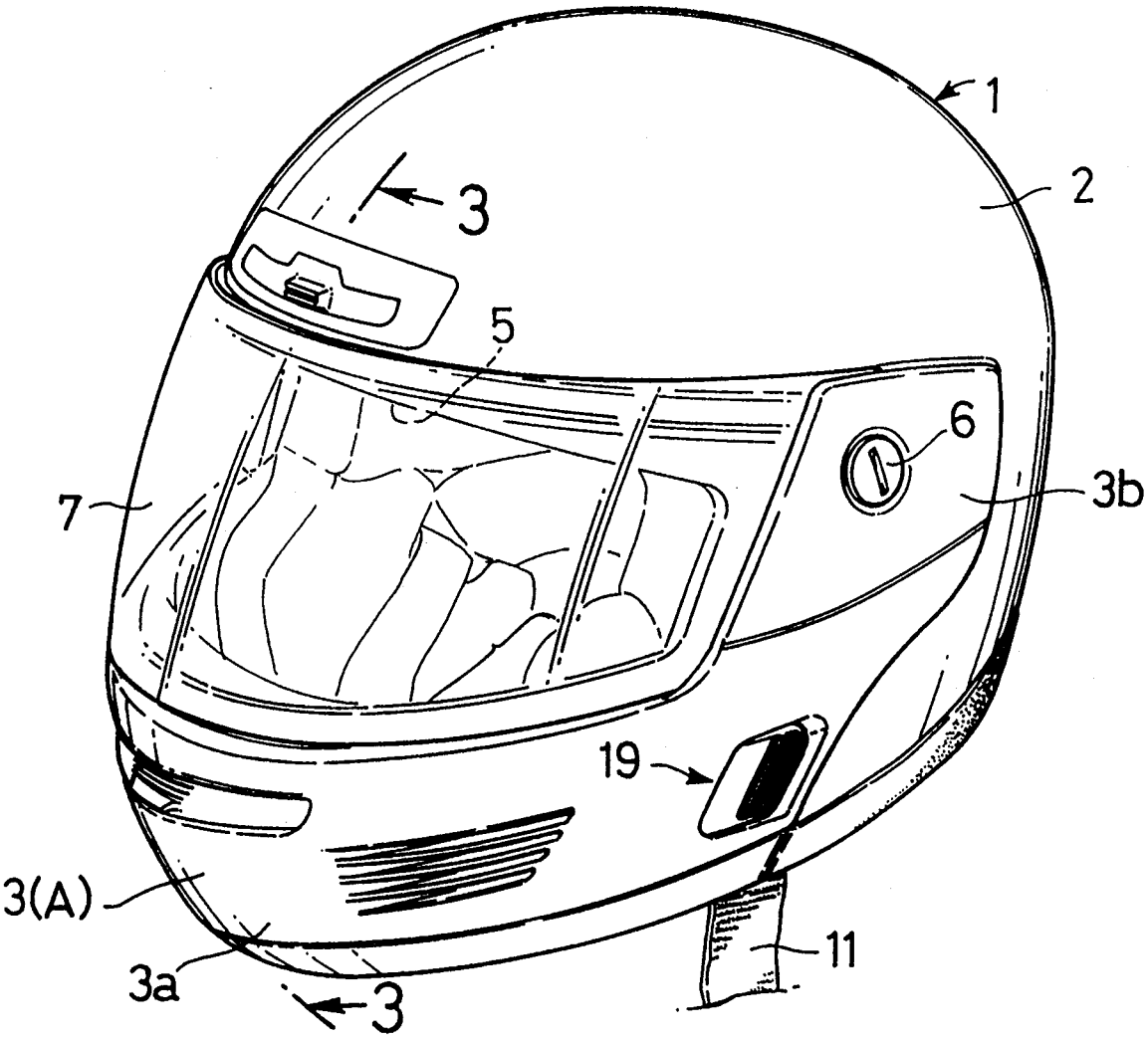
FIG. 1 is a perspective view of a helmet for riding a vehicle according to a preferred embodiment of the present invention.
Figure 2:
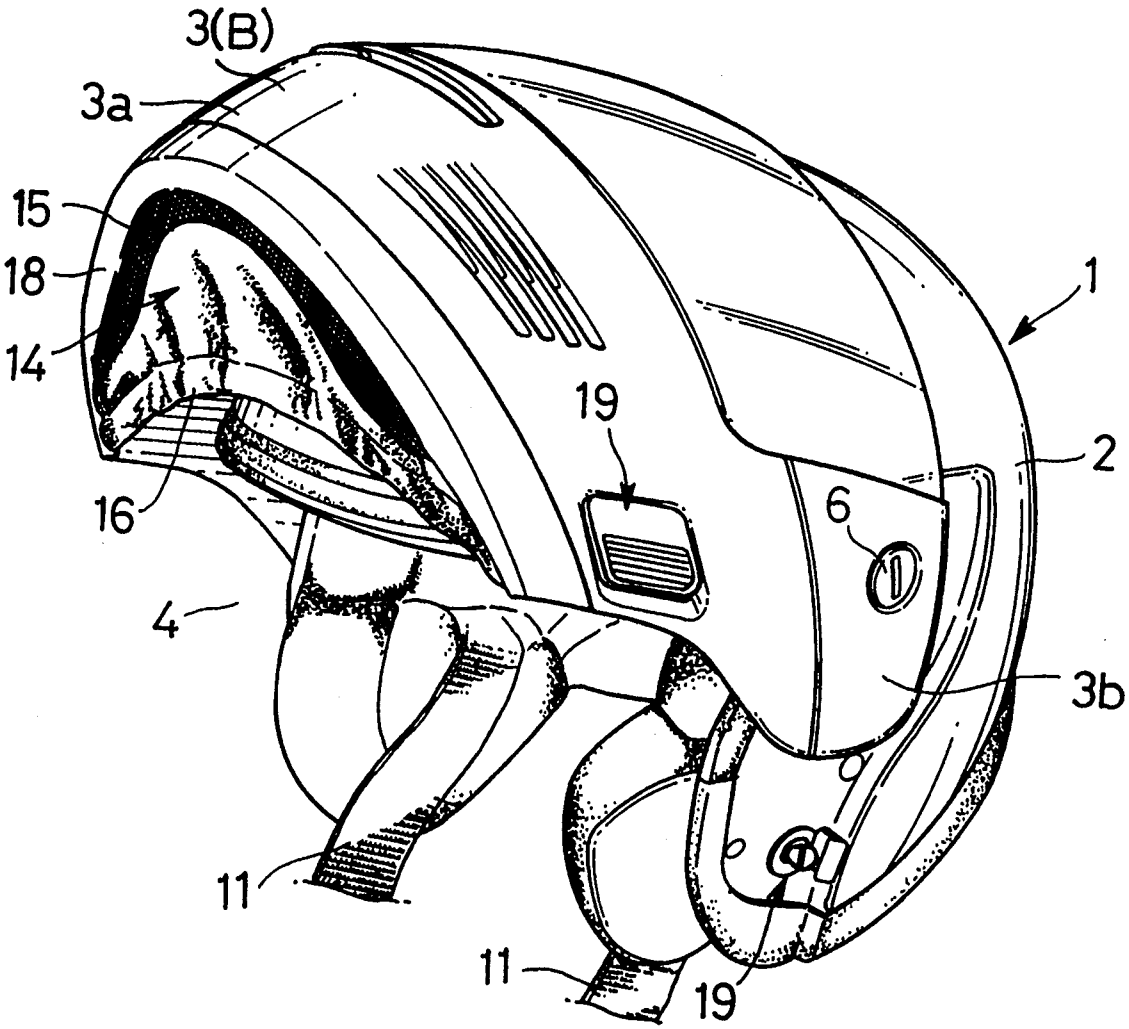
FIG. 2 is a perspective view of the helmet with its auxiliary cap body turned to a lifted position.

FIGS. 1 and 2 illustrate the entire helmet for riding a vehicle. As shown in FIGS. 1 and 2, a cap body of the helmet is comprised of a main cap body 2 and an auxiliary cap body 3. The main cap body 2 is formed into a so-called jet type so as to cover a user's head excluding a face. Therefore, the main cap body 2 has a large window 4 at a front surface of the main cap body 2, which is opened at a lower edge thereof.

The auxiliary cap body 3 includes a chin-covering portion 3*a* curved to expand forwardly, and a pair of ear portions 3*b*, 3*b* extending upwardly from left and right opposite ends of the chin-covering portion 3*a* and carried on left and right sides of the main cap body 2 through pivots 6. The auxiliary cap body 3 is capable of turning between a lowered position A (FIG. 1) and a lifted position B (FIG. 2). Thus, the auxiliary cap body 3 closes, at the lowered position A, a lower half of the large window 4 at the main cap body 2 to cover a user's chin by the chin-covering portion 3*a*, so that an upper half of the large window 4 being defined as a small window 5. On the other hand, if the auxiliary cap body is turned to the lifted position B, the chin-covering portion 3*a* is shifted to a position above the large window 4 to open this large window 4 entirely. A lock mechanism 19 is provided between the main and auxiliary cap bodies 2 and 3. This lock mechanism 19 is capable of locking the auxiliary cap body 3 at the lowered position A.

A light-permeable shield plate 7 is pivotally carried on the auxiliary cap body 3 coaxially with the pivots 6 for vertical rotating movement to open and close the small window 5.

Figure 3:
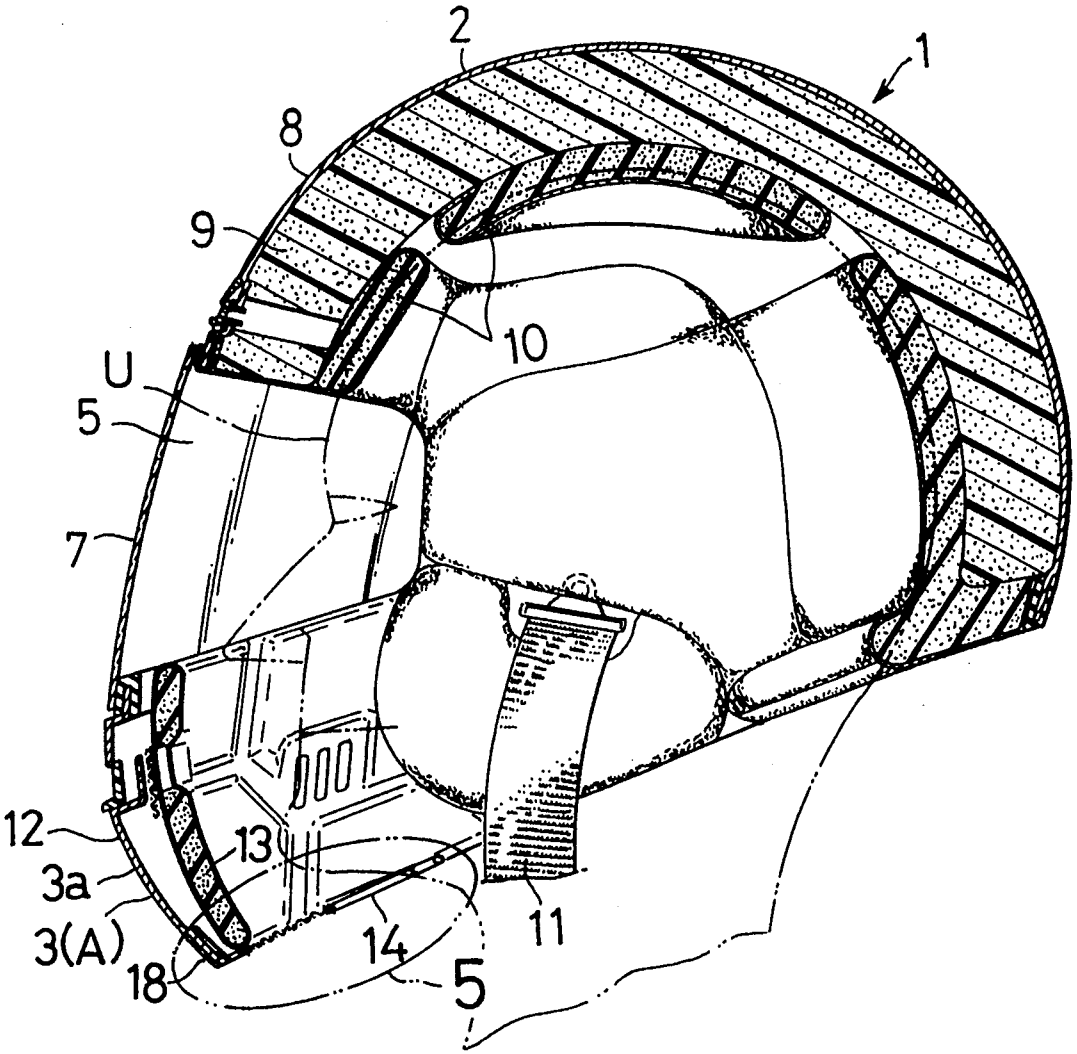
FIG. 3 is a sectional view taken along line 3—3 in FIG. 1.

FIG. 3 is a longitudinal sectional view of the cap body 1. As shown in FIG. 3, the main cap body 2 is comprised of a shell 8 made of FRP, a shock-absorbing liner 9 made of an expanded polystyrene material mounted on an inner surface of the shell 8, and a fit pad 10 made of a urethane foam material further lined on the liner 9. A chin belt 11 is rivetted at its base end to the shell 8.

The auxiliary cap body 3 is comprised of a shell 12 injection-molded from a synthetic resin material, and a chin pad 14 made essentially of a urethane foam material and lined only on such a portion of the shell 12 which faces the large window 4.

Figure 4:
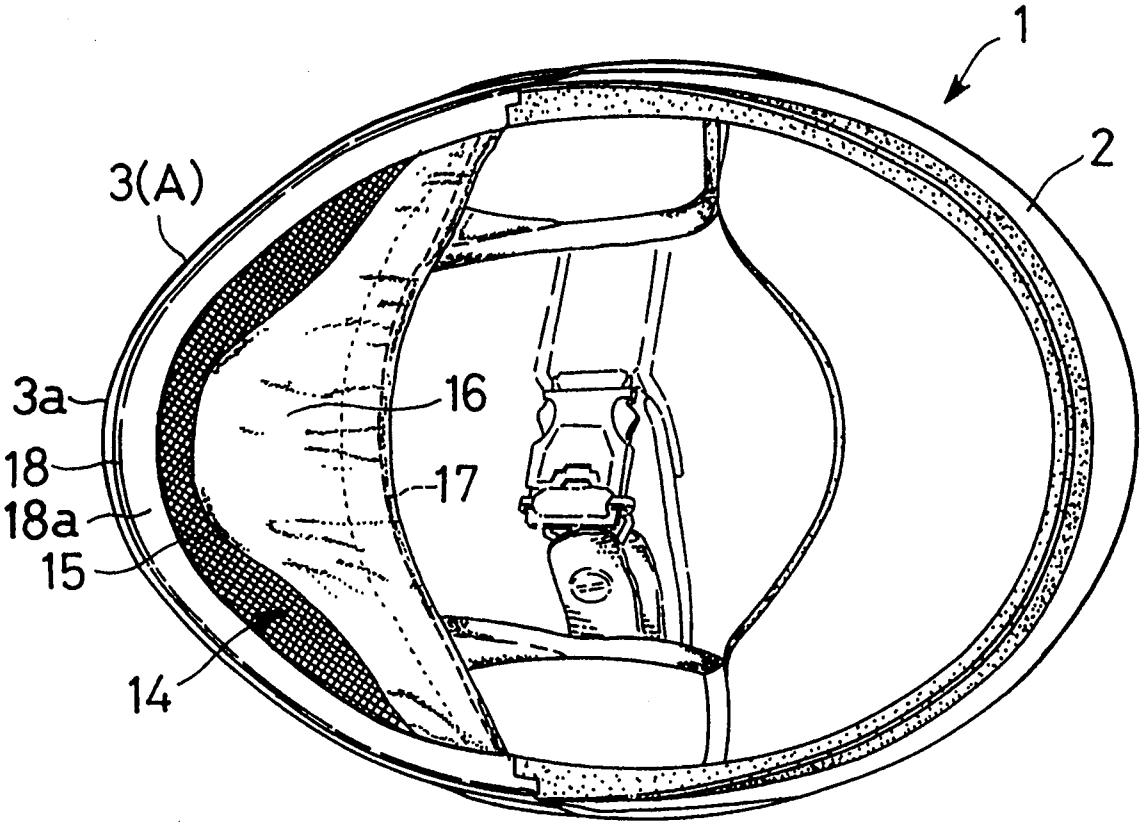
FIG. 4 is a bottom view of the helmet.
Figure 5:
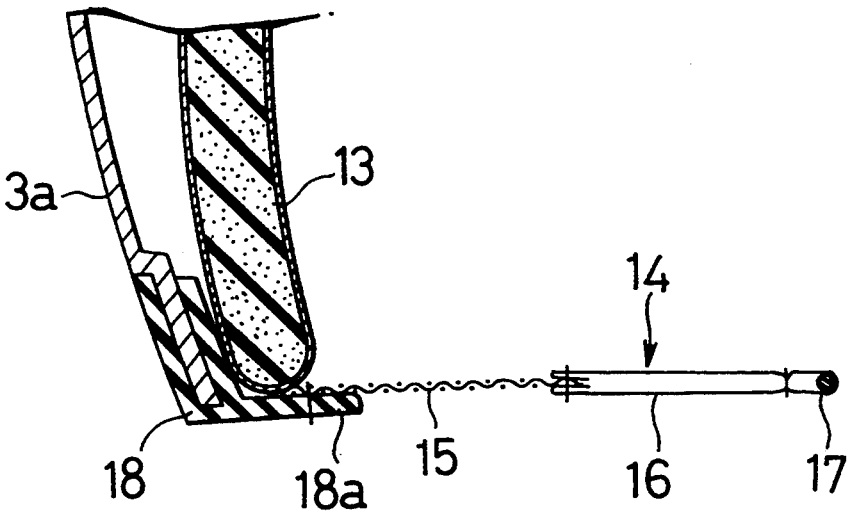
FIG. 5 is an enlarged view of a portion indicated by 5 in FIG. 3.

Referring to FIGS. 3 and 4, a chin cover 14 is upholstered at a lower edge of the chin covering portion 3*a* for covering a chin of a user U from below.

The chin cover 14 is crescent-shaped as viewed in plan, as shown in FIG. 4. A front region of the chin cover 14 is made of a mesh material 15 and a rear region thereof is made of a fabric material 16. A rear edge 17 of the fabric material 16 is crimped so that it can be expanded and contracted laterally. Such rear edge has a resilient string made of a rubber sewn therein. On the other hand, a trimming member 18 made of a synthetic resin material is mounted to a lower edge of the shell 12 of the chin covering portion 3*a*, and is integrally provided with a protrusion 18*a* integrally which protrudes inwardly from a lower edge of the trimming member 18. And the chin cover 14 is sewn at its front edge to the protrusion 18*a*.

When the user U wears the cap body 1, the main cap body 2 is first put on a head of the user U in a condition in which the auxiliary cap body 3 has been previously turned to the lifted position B and retained there. If doing so, the attachment of the main cap body 2 can easily be performed without any obstruction by the chin covering portion 3*a* of the auxiliary cap body 3 and the chin cover 14 and hence, the user's hair cannot be disheveled.

If the auxiliary cap body 3 is then turned to the lowered position A, the chin cover 14 is once stretched by a chin of the user U and then contracted to cover a lower portion of the user's chin.

If the user U puts on the cap body 1 and drives, for example, a motorcycle, a traveling air passing along a lower surface of the cap body 1 is guided to the chin cover 14 to flow rearwardly, especially when driving the motorcycle at a high speed, so that the wind is prevented from entering into the chin covering portion 3*a*. Thus, it is possible to prevent the generation of a wind-cutting sound due to the entry of wind. Moreover, since the wind flows at a high speed at a lower surface of the chin cover 14, particularly at the front region thereof, the pressure is reduced around such a region. Therefore, the flowing-out of a user's exhalation from the chin covering portion 3*a* through the mesh material 15 is promoted, thereby preventing the clouding of the inner surface of the shield plate 7 due to the stay of the exhalation.

In order to remove the cap body 1, a reverse procedure from the above-described procedure is performed. More specifically, the auxiliary cap body 3 is first turned to the lifted position B and then, the main cap body 2 is removed. Even in this case, the disheveling of the user's hair by the auxiliary cap body 3 and the chin cover 14 is prevented.

If the user wearing the cap body 1 turns the auxiliary cap body 3 to the lifted position B, he or she can smoke, eat and drink through the large window 4 of the main cap body 2.

It will be understood that various modifications in design to the above-described embodiment can be made without departing from the spirit and scope of the invention defined in claims. For example, the present invention is also applicable to a usual integral full face type cap body in which a main cap body 2 and an auxiliary cap body 3 are integral with each other. In addition, the entire chin cover 14 can be formed of a mesh material.

What is claimed is:

1. A helmet for riding a vehicle, having a cap body and a chin covering portion provided in said cap body for covering a chin of a user, said cap body comprising:

a main cap body having a large window opened at a lower front end of the main cap body; and an auxiliary cap body forming said chin covering portion and carried on left and right sidewalls of said main cap body for turning movement between a lowered position, in which a lower half of said large window is covered with said chin covering portion to define an upper half of said large window into a small window, and a lifted position, in which said large window is entirely opened, wherein said chin covering portion is provided at a lower edge thereof with an expandable and contractible chin cover for covering a lower face of the chin of the user, and a portion of said chin cover is made of a mesh material of a property permitting an inhalation and exhalation therethrough by breathing of the user, and said chin covering portion also including resilient urging means, operatively connected to said chin cover, for resiliently urging at least a rear edge portion of said chin cover into a contracted state.

2. A helmet for riding a vehicle according to claim 1, wherein said chin cover is crescent-shaped and said mesh material is used to form a front side portion of said chin cover.

3. A helmet for riding a vehicle according to claim 1, wherein said resilient urging means comprises a rubber string sewn at a rear edge portion of said chin cover.

4. A helmet for riding a vehicle according to claim 2, wherein said resilient urging means comprises a rubber string sewn at a rear edge portion of said chin cover.

* * * * *